United States Patent [19]

Inamura

[11] Patent Number: 4,502,190

[45] Date of Patent: Mar. 5, 1985

[54] SLIDE FASTENER STRINGER

[75] Inventor: Akio Inamura, Nyuzen, Japan

[73] Assignee: Yoshida Kogyo K. K., Tokyo, Japan

[21] Appl. No.: 496,074

[22] Filed: May 19, 1983

[30] Foreign Application Priority Data

May 19, 1982 [JP] Japan ..... 57-73379[U]
May 19, 1982 [JP] Japan ..... 57-73380[U]

[51] Int. Cl.[3] ..... A44B 19/00
[52] U.S. Cl. ..... 24/389; 24/403
[58] Field of Search ..... 24/389, 403

[56] References Cited

U.S. PATENT DOCUMENTS 3,111,738 11/1963 Bair ..... 24/389
4,312,102 1/1982 Fukuroi ..... 24/389

*Primary Examiner*—Philip C. Kannan
*Attorney, Agent, or Firm*—Hill, Van Santen, Steadman & Simpson

[57] ABSTRACT

A water-resistant slide fastener stringer has a stringer tape including face and back layers of resilient and water-resistant elastomer, a row of coupling elements mounted on the stringer tape along one longitudinal edge thereof, and layers of resilient and water-resistant elastomer integral with the face and back layers and including portions interconnecting adjacent ones of the coupling elements and having lateral slots extending transversely of the stringer tape. The coupling elements are securely fastened to the stringer tape by the resilient and water-resistant layers. The stringer is kept relatively flexible by the slots in the layers extending across the coupling elements.

5 Claims, 6 Drawing Figures

SLIDE FASTENER STRINGER

BACKGROUND OF THE INVENTION

1. Field of the Invention

The present invention relates to a slide fastener stringer, and more particularly to a water-resistant slide fastener stringer having seal means for protection against water leakage between intermeshing rows of coupling elements.

2. Description of the Prior Art

Known water-resistant, or water-proof, slide fastener stringers comprise a water-resistant stringer tape and coupling elements mounted thereon by extrusion molding. The stringer tape is composed of a woven or knit web having face and back layers of elastomer such as natural or synthetic rubber, and a sealing fin projecting from the element-supporting edge of the stringer tape toward the coupling heads of companion coupling elements. When two such stringers are coupled together and immersed in water, the sealing fins are brought into tight contact with the coupling heads, thereby hermetically sealing the intermeshing coupling elements against water leakage. Since the sealing fins are pressed against the coupling elements during use, it is necessary that the coupling elements be firmly attached to the stringer tapes for protection against unwanted displacement or tilting under usage, which would lower the water-resistant capability and make the slide fastener malfunction. Attempts to attach the coupling elements too securely to the stringer tape, however, would render the slide fastener less flexible than required, resulting in the danger that the interdigitating coupling elements might become separated or broken apart.

SUMMARY OF THE INVENTION

It is an object of the present invention to provide a water-resistant slide fastener stringer having coupling elements securely attached to a stringer tape along a longitudinal edge thereof.

Another object of the present invention is to provide a water-resistant slide fastener stringer which is relatively flexible but ensures secure coupling engagement between mating rows of coupling elements against the latter's being accidentally separated or broken apart when forcibly bent over or subjected to a transverse thrusting force.

Still another object of the invention is to provide a water-resistant slide fastener stringer in which leg portions of each coupling element is covered by water-resistant elastomer with the uppermost and lowermost faces of the leg portions left not covered so that the inner walls of a slider can contact only such exposed or non-covered portions of the coupling elements, thus causing smooth movement of the slider.

According to the present invention, a row of coupling elements is mounted on a stringer tape and firmly secured thereto by first resilient and water-resistant layers on the surfaces of the stringer tape and second resilient and water-resistant layers integral with the first resilient and water-resistant layers and having portions interconnecting adjacent ones of the coupling elements and having lateral slots extending transversely of the stringer tape. The stringer is kept relatively flexible by the slots in the layers extending across the coupling elements. Each of the coupling elements is composed of a pair of halves mounted respectively on the surfaces of the stringer tape and each including a leg portion placed on the stringer tape, a neck portion projecting from the leg portion, and a coupling head contiguous to the neck portion. The leg portion has in a surface thereof remote from the stringer tape a pair of lateral recesses and a groove extending across therebetween, the second resilient and water-resistant layers having portions disposed in the lateral recesses and grooves in the coupling elements.

Many other advantages and features of the present invention will become manifest to those versed in the art upon making reference to the detailed description and the accompanying sheets of drawings in which a preferred structural embodiment incorporating the principles of the present invention is shown by way of illustrative example.

DESCRIPTION OF THE PREFERRED EMBODIMENT

Figure 1:
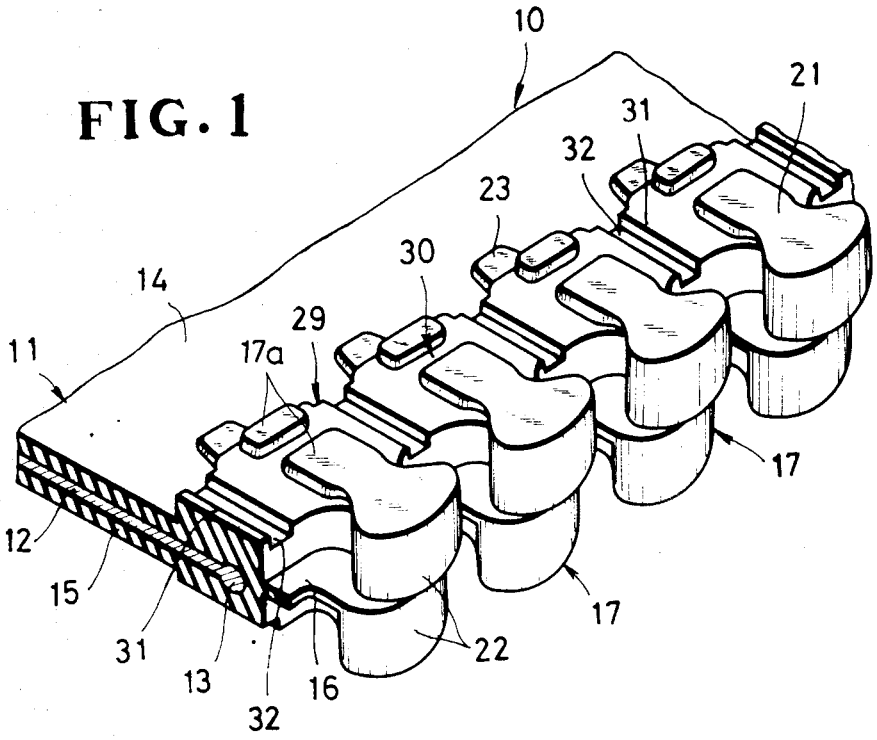
FIG. 1 is a fragmentary perspective view of a water-resistant slide fastener stringer.

The present invention is particularly useful when embodied in a slide fastener stringer generally designated by the reference numeral 10 in FIG. 1.

The slide fastener stringer 10 includes an elongate stringer tape 11 composed of a woven or knit web core 12 having a longitudinal beaded edge 13. The web core 12 is covered with face and back layers 14, 15 of resilient and water-resistant elastomer such as natural or synthetic rubber, the layers 14, 15 being coated or extrusion-molded on the web core 12. The stringer tape 11 also has a sealing fin 16 projecting from the beaded edge 13 and lying in the plane of the stringer tape 11, the sealing fin 16 being made of the same material as that of the layers 14, 15 and thinner so as not to impair the felxibility of the stringer 10. In the particular embodiment, the sealing fin is thinner than the web core 12.

Figure 2:
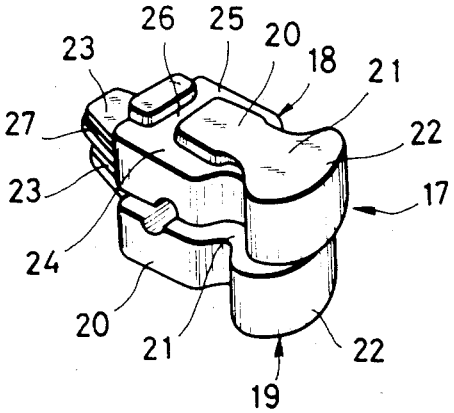
FIG. 2 is a perspective view of a coupling element on the slide fastener stringer shown in FIG. 1.
Figure 3:
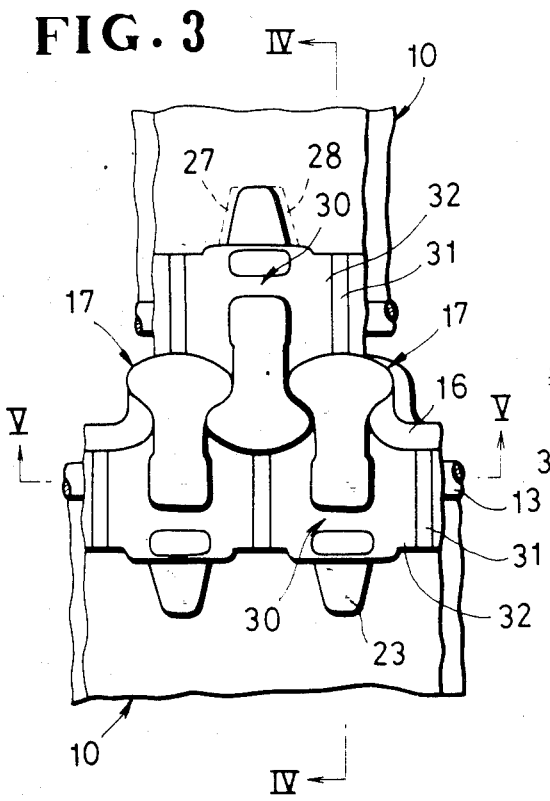
FIG. 3 is a fragmentary plan view of a pair of intermeshing water-resistant slide fastener stringers.

A row of coupling elements 17 is mounted on the web core 12 across the beaded edge 13, the coupling elements 17 being formed of either synthetic resin by extrusion molding or metal by die casting. As illustrated in FIG. 2, each of the coupling elements 17 comprises a pair of upper and lower halves 18, 19 slightly displaced from each other in the longitudinal direction of the stringer tape 11 and disposed on the marginal edge of the stringer tape 11 including the beaded edge 13. Each of the upper and lower halves 18, 19 includes a wide leg portion 20 placed on the stringer tape 11, a narrower neck portion 21 projecting from the leg portion 20 beyond the beaded edge 13, and a round coupling head 22 joined to the neck portion 20. Each coupling element half 18, 19 also includes a rear tongue 23 disposed on the web core 12 and extending away from the coupling head 22. Each wide leg portion 20 has, in an upper surface thereof remote from the stringer tape 11, a pair of lateral recesses 24, 25 and a groove 26 extending across between the lateral recesses 24, 25. Each rear tongue 23 also has a pair of lateral recesses 27, 28 (FIG. 3) in an upper surface thereof which define shoulders engaged by the layers 14, 15.

Figure 5:
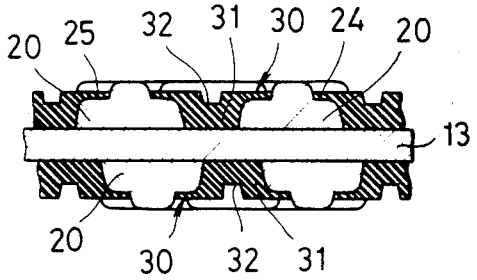
FIG. 5 is a cross-sectional view taken along line V—V of FIG. 3.

As illustrated in FIGS. 1 and 5, the wide leg portions 20 on each stringer tape surface are covered with an elongate layer 29 integral with one of the layers 14, 15 and having portions 30 disposed in the lateral recesses 24, 25 and the groove 26 and portions 31 interconnecting adjacent coupling elements 17. The layer 29 laterally extends beyond the beaded tape edge 13 and terminates at the narrower neck portion 21 of the coupling elements 17. The layer 29 is made of the same material as that of the layers 14, 15, and has a thickness slightly smaller than that of exposed portions 17*a* of each coupling element 17. Each of the interconnecting portions 31 has a lateral slot 32 extending transversely of the stringer tape 11.

Figure 4:
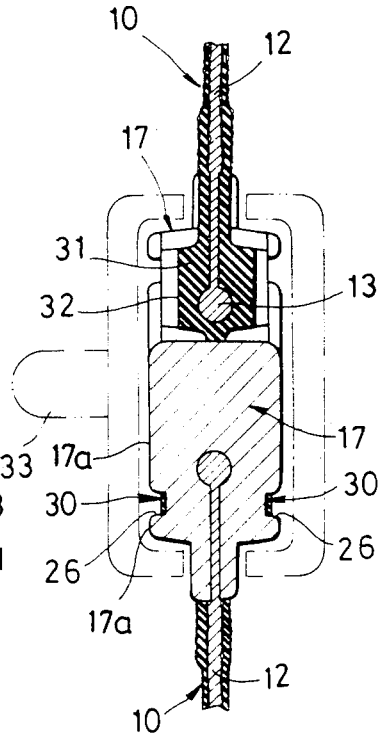
FIG. 4 is a cross-sectional view taken along line IV—IV of FIG. 3.

In use, the coupling elements 17 of two slide fastener stringers 10, 10 are coupled together as shown in FIG. 4 by a slider 33. After the slide fastener 10 has been closed by the slider 33, during which time the inner walls of the slider 33 contact only the exposed portions 17*a* of the coupling elements 17. The sealing fins 16 of the stringers 10, 10 are pressed edgewise against peripheral surfaces of the coupling heads 22 of the opposite coupling elements 17, thus providing a hermetic seal between the mating slide fastener stringers 10, 10 against water leakage therebetween.

Figure 6:
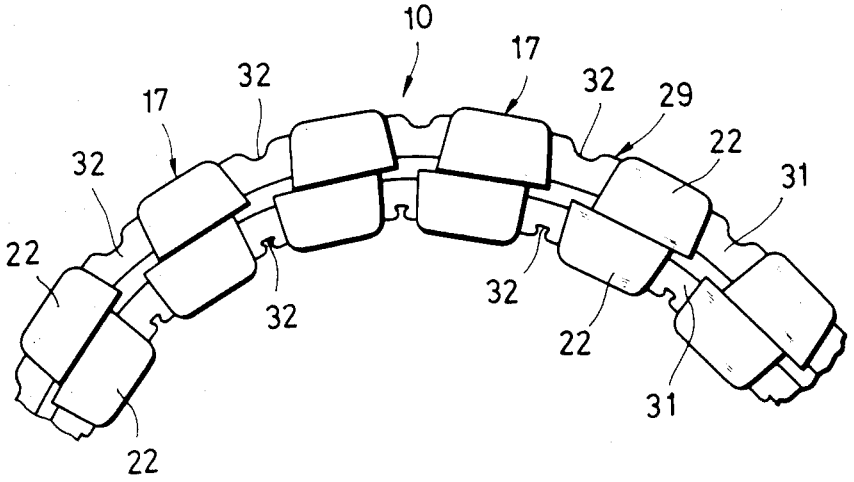
FIG. 6 is a front elevational view of the water-resistant slide fastener stringer illustrated in FIG. 1.

With the layers 24, 25 and the layers 29 integrally coated or extrusion-molded on the web core 12 and the rows of coupling elements 17, 17, the coupling elements 17, 17 are securely fastened to the web core 12 against accidental displacement. Though the layers 29 are mounted on the coupling elements 17, the stringer 10 remains relatively flexible because of the slots 32 defined in the layers 29. FIG. 6 shows the manner in which the stringer 10 flexes when subjected to an external bending force. When the stringer 10 is bent, the slots 32 on the convex side of the stringer 10 spread open while those on the concave side become narrowed, thus assisting the stringer 10 in flexing relativey easily with a small force applied. Further, since the uppermost and lowermost faces 17*a* of the element leg portions are not covered with the layer 29, the inner walls of the slider 33 can contact only such exposed portions 17*a* of the coupling elements 17, thus enabling smooth movement of the slider 33.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener stringer comprising:

(a) an elongated stringer tape having first resilient and water-resistant layers on both surfaces thereof;

(b) a row of coupling elements mounted on a longitudinal marginal edge of said stringer tape;

(c) a second resilient and water-resistant layer mounted on each surface of said stringer tape along said row of coupling elements and integral with one of said first resilient and water-resistant layers, said second resilient and water-resistant layer having portions covering said coupling elements in part and also having portions interconnecting adjacent ones of said coupling elements, said coupling-element-interconnecting portions having slots extending transversely of said stringer tape; and (d) a resilient and water-resistant sealing fin projecting laterally from said longitudinal marginal edge of said stringer tape and lying in the plane of said tape.

2. A slide fastener stringer according to claim 1, each of said coupling elements having uppermost and lowermost portions not covered with said second resilient and water-resistant layer so that said uppermost and lowermost portions of said coupling elements can contact inner walls of a slider.

3. A slide fastener stringer according to claim 1, each of said coupling elements comprising a pair of members mounted respectively on said surfaces of said stringer tape, each of said members having a leg portion placed on said longitudinal marginal edge, a neck portion extending from said leg portion beyond said longitudinal marginal edge, and a coupling head contiguous to said neck portion, said leg portion having a pair of lateral recesses in a surface thereof remote from said stringer tape, said coupling-element-covering portions of said second resilient and water-resistant layer including a portion disposed in said lateral recesses.

4. A slide fastener stringer according to claim 3, said leg portions also having a groove extending across between said lateral recesses, said coupling-element-covering portions of said second resilient and water-resistant layer including a portion disposed in each said groove.

5. A slide fastener stringer according to claim 3, each of said members also having a tongue portion extending away from said coupling head and having shoulders engaged by one of said first resilient and water-resistant layers.

* * * * *